US005434658A

United States Patent [19]

Kwon

[11] Patent Number: 5,434,658

[45] Date of Patent: Jul. 18, 1995

[54] APPARATUS FOR GUIDING OF THE ENTRANCE OF COPY SHEETS FOR USE IN ELECTROSTATIC COPY MACHINES

[75] Inventor: Chang M. Kwon, Kyeongki-do, Rep. of Korea

[73] Assignee: Hyundai Electronics Ind. Co., Ltd., Kyeongki-Do, Rep. of Korea

[21] Appl. No.: 129,328

[22] Filed: Sep. 30, 1993

[30] Foreign Application Priority Data

Oct. 8, 1992 [KR] Rep. of Korea ..... 18506P92

[51] Int. Cl.[6] ..... G03G 15/20

[52] U.S. Cl. ..... 355/285; 219/216; 355/283; 355/309; 432/60

[58] Field of Search ..... 355/282, 283, 285, 290, 355/308, 309, 315, 317; 219/216, 469, 470; 432/60

[56] References Cited

U.S. PATENT DOCUMENTS

| | | | |
|---|---|---|---|
| 3,883,292 | 5/1975 | Hamaker | 432/60 |
| 3,980,424 | 9/1976 | Latone | 432/60 X |
| 4,355,881 | 10/1982 | Tarumi et al. | 219/216 X |
| 4,843,214 | 6/1989 | Higashi et al. | 219/216 |
| 4,859,831 | 8/1989 | Webb | 219/216 |
| 4,860,047 | 8/1989 | Pirwitz | 355/290 |
| 4,876,576 | 10/1989 | Itaya et al. | 355/285 |
| 4,937,631 | 6/1990 | Kim et al. | 355/290 |

*Primary Examiner*—William J. Royer
*Attorney, Agent, or Firm*—Bradford E. Kile; Kevin M. O'Brien; Ruffin B. Cordell

[57] ABSTRACT

An apparatus for fixing a copy paper for use in electrophotographic appliances, such as laser beam printers or copying machines, includes components for stretching the leading edges of copy sheets at the entry of the nip defined by the fixing station for preventing crumpling of the copy sheets, reverse pressure component for bowing downward and flattening the leading edges of the copy sheets, and cleaning device including a cleaning box provided with a roller brush which is rotatable in the same direction as the heating roller for cleaning up the periphery of the heating roller, and a brush cleaning member for dusting off the roller brush. With this arrangement, when two-sided copying of the copy sheets is performed, jamming of copying sheets is prevented, thus improving copying efficiency.

6 Claims, 4 Drawing Sheets

APPARATUS FOR GUIDING OF THE ENTRANCE OF COPY SHEETS FOR USE IN ELECTROSTATIC COPY MACHINES

BACKGROUND OF THE INVENTION

This invention relates to copying machines and particularly to apparatus for fixing copy paper for use in electrophotographic appliances, such as laser beam printers or copying machines.

In conventional electrophotographic appliances, toner is transferred to copy sheets by a photosensitive drum and the toned copy sheets are fed to a fixing roller. The copy sheets are required to be flattened at their leading edge when they pass the fixing roller. For this purpose, some fixing structures have been proposed.

One of the fixing structures comprises a heating roller having various diameters. That is, the diameter of the opposite ends of the roller are larger than that of the middle portion of the roller. With this construction, when copy sheets pass the fixing station, they come in contact with the heating roller irregularly, which makes their coefficient of linear expansion different. Accordingly, the copy sheets were frequently crumpled.

Another fixing structure includes a copy sheet guide having guide ribs. Of the guide ribs, the middle rib is higher than the end ribs, which prevents sagging of copy sheets at the leading edges thereof. Otherwise, a bias voltage having a polarity opposite to that of the toner on the copy sheets is applied from the copy sheet guide. With this construction, the attraction between the polarities enables the leading edges of the copy sheets to be flattened.

The above conventional fixing structure was of little use in feeding the copy sheets in a flattened and correct state.

It is economical to use both sides of copy sheets. For this purpose, copy sheets are required to be flattened at their leading edges after fixation.

In the conventional fixing device as shown in FIG. 5, which is used in laser beam printers or desk-type copying machines, the outside diameter of the heating roller 1 in contact with the pressure roller 3 is smaller than that of the pressure roller, whereby the leading edges of copy sheets 2 bow in the circumferential direction of the heating roller 1 when passing through a nip defined between adjacent peripheries of the rollers 1 and 3.

The discharge of the copy sheets in the bent state at their front edges cause the front edges to be caught in the fixing station when one side copied sheet re-passes the fixing station for copying on the other face. This also causes paper jams in the machine.

A conventional cleaning means 6 in contact with the heating roller 1 is fixed with respect to the heating roller 1. The foreign matters removed from the heating roller 1 are stacked below the cleaning means 6.

This conventional fixing station has no means for removing the foreign matters stacked below the cleaning means 6 and the stacked foreign matters damage the surface of the heating roller when passing the space between the cleaning means and the heating roller, thus decreasing the life of the fixing means. Furthermore, the face of the copy sheet having passed the fixing means becomes filthy, thus lowering fixing performance and quality of the copying device.

SUMMARY OF THE INVENTION

An object of the present invention is to provide a fixing apparatus enabling copy sheets to pass therethrough in a stable state. For this purpose, the fixing means has copy sheet stretching means for maintaining the tightly stretching state of the copy sheets at the entry of the nip of the fixing means with the leading edge thereof being pressed. After passing the heating roller, the copy sheets are applied with a force from a direction opposite to the pressed direction, causing the bent leading edges of the copy sheets to be flattened.

Another object of the present invention is to provide a fixing apparatus with cleaning means, the cleaning means including a rotatable brush for cleaning the heating roller and a brush cleaning member for dusting off the brush.

Still another object of the present invention is to provide a fixing apparatus, wherein a copy sheet is used economically and the life of the fixing roller is lengthened by using a copy sheet flattening means and a roller brush in a cleaning box.

The fixing device according to the object of the present invention comprises: a fixing station for fusing the toner on copy sheets, a heating roller 1 and a pressure roller 3 incorporated in the fixing station; Sheet stretching means incorporating a pair of opposite sheet stretching members 5 located adjacent to the entry side of the fixing station, each sheet stretching member 5 including guide means 4 having guide ribs 41 thereon for feeding the copy sheets therealong, and a guide roller 53 and support ribs 51 for stretching the leading edges of the copy sheets on the guide ribs 41; Reverse pressure means 10 including a pivotable flattening member 7 and a discharge roller 8 for exerting a force enabling the leading edges of the copy sheets having passed to bow downward while entering a discharge plate 9; Cleaning means 13 including a cleaning box 16 provided with a roller brush 14 which is rotatable in the same direction as the heating roller 1 for cleaning up the periphery of the heating roller 1, and a brush cleaning member 15 for dusting off the roller brush 14.

DETAILED DESCRIPTION OF THE INVENTION

Figure 1A:
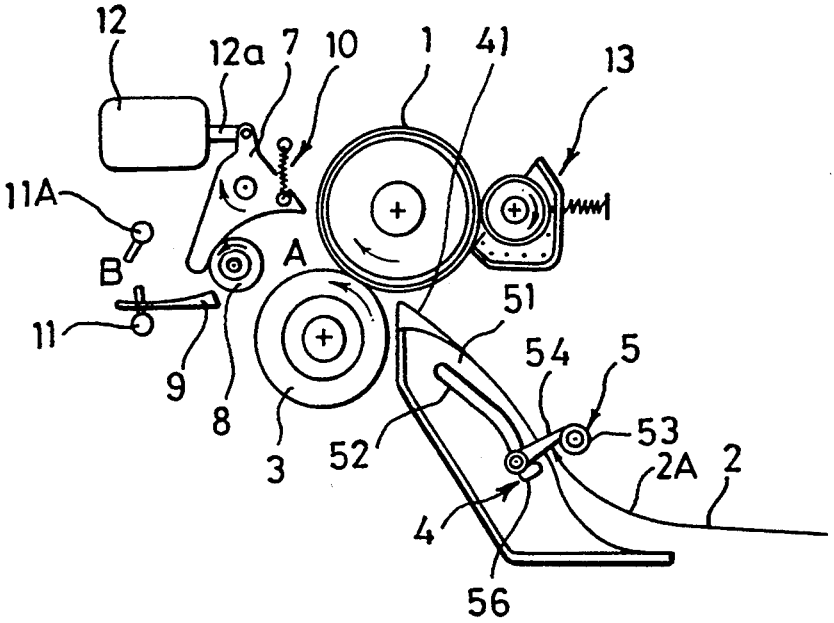
FIG. 1A is a cross sectional view showing the side of the fixing apparatus of the present invention.

A fixing apparatus in a copying machine, or the like, comprises a heating roller 1 for fusing the toner on copy sheets 2 and a pressure roller 3 for transferring the toner to the copy sheets 2, the rollers 1 and 3 defining a fixing station. The peripheries of the rollers 1 and 3 are in contact with each other.

Guide means 4 are mounted at the entry side of the rollers 1 and 3 and a discharge plate 9 is mounted at the discharge side of the rollers 1 and 3.

Cleaning means 13 including a roller brush 14 with bristles 14*a* are in contact with the periphery of the heating roller 1 and above the guide means 4 for cleaning the heating roller 1. A cleaning box 16 for collecting foreign matters from the heating roller 1 and the roller brush 14 is located around the roller brush 14, and houses a brush cleaning member 15.

Reverse pressure means 10 are mounted above the discharge plate 9 at the discharge side of the fixing station for downward bowing and flattening the leading edges of the copy sheets 2.

Figure 1B:
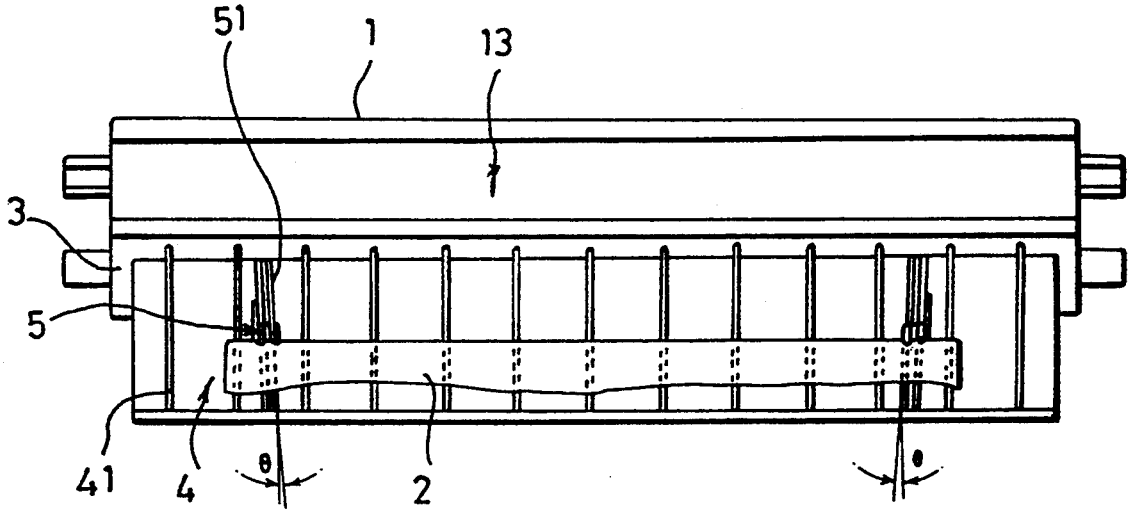
FIG. 1B is a front view showing the construction of the fixing apparatus of the present invention.

FIG. 1A is a sectional view showing the edge of the fixing apparatus of the present invention and FIG. 1B is a front view of the fixing apparatus of the present invention.

The guide means 4 includes a plurality of guide ribs 41 which are spaced a predetermined distance from one another and disposed parallel to the copy sheets 2 to be fed thereon with minimum friction. A pair of opposite sheet stretching members 5 defining sheet stretching means are disposed symmetrically and oppositely for stretching the copy sheets 2. Each stretching member 5 is mounted between two of the end-located guide ribs 41.

Each sheet stretching member 5 includes a support rib 51 having a side curved slit 52 for slidingly receiving one end of an arm 54. A guide roller 53 is rotatably mounted on the other end of the arm 54. With this arrangement, the arm 54 moves through ninety degrees with respect to the curved slit 52.

The support rib 51 of each of the sheet stretching members 5 have approximately the same shape as and are shorter than the guide ribs 41, as shown in FIG. 1A. The difference of the height between the support ribs 51 and the guide ribs 41 defines a groove adjacent to the fixing station.

Figure 2A:
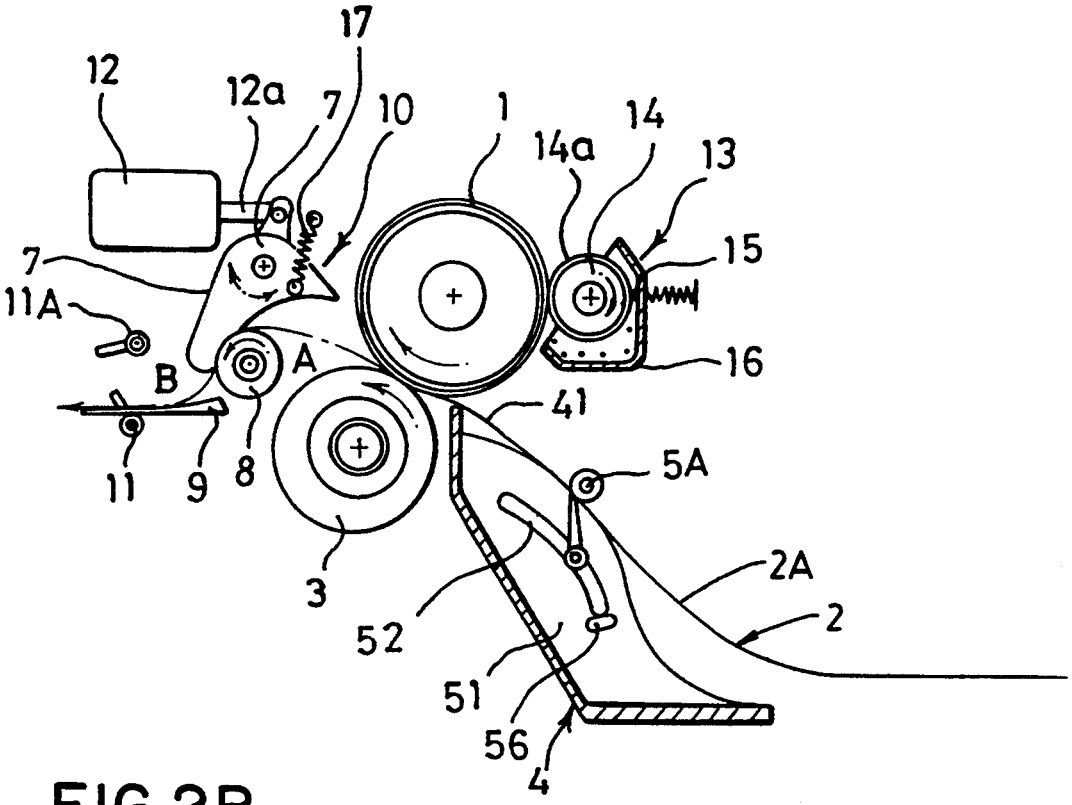
FIG. 2A is a side view of the fixing apparatus of the present invention showing the leading edge of a copy sheet in a flattened state.

When the arm 54 slides along the curved slit 52, the arm assumes rotating position 5A shown in FIG. 2A from the vertical position shown in FIG. 1 by the feed force of the copy sheets. With continuous movement of the copy sheets, the rotation of the arm 54 is stopped at the uppermost end of the curved slit 52 causing the arm 54 to be parallel with the guide rib 41 and the guide roller 53 to insert in the groove between the guide rib 41. This is shown as state 5B in FIG. 2B. The leading end of the copy sheets moving on the guide rib 41 is then removed between the guide roller 53 and the arm 54.

For producing a force for stretching the copy sheets, each support rib 51 is inclined at a predetermined angle of $\theta$ with respect to the guide ribs 41.

A stop 56 protrudes from the lower end of the curved slit 52 for preventing downward movement of the arm 54. When stopped by the stop 56, the arm 54 becomes perpendicular to the leading edges of the copy sheets 2 and to the guide means 4.

The reverse pressure means 10 includes a discharge roller 8 which is smaller than the pressure roller 3 in diameter. A pivotable flattening member 7 in contact with the periphery of the discharge roller 8 defines a discharge path B. Sensors 11 and 11A are fixed to the discharge plate 9 for sensing the entry or discharging of the copy sheets 2.

The operation of the fixing apparatus of this invention is as follows. The copy sheets 2 having passed a developing station (not shown) move along the curved face of the guide ribs 41 of the guide means 4. Thereafter, the leading edges of the copy sheets 2 make contact with the arm 54 and the guide roller 53. The feed force of the copy sheets 2 causes the arm 54 with the leading ends of the copy sheets 2 to slide upwardly along the curved slit 52 and to rotate counterclockwise.

Upon rotation of the arm 54, the guide roller 53 is inserted into the groove defined by the guide ribs and the support ribs 41, and 51. Upon the insertion of the guide roller 53, the leading edges of the copy sheets are removed from the guide roller 53 and advanced to a feed path A.

With the arms 54 being respectively mounted at the oppositely disposed support ribs 51, the copy sheets 2 are stretched tightly at the leading edges thereof while being fed along the guide ribs 41.

The inserted distance of the copying sheets is approximately 2 mm from the leading edges, and generally the toned image is not transferred to a portion of 3 mm from the leading edges of the copy sheets. Therefore, the toner is not likely to be applied to the guide roller 53. It is preferred that the distance between the opposite arms 54 is smaller than the width of copy sheets of minimum width.

Figure 2B:
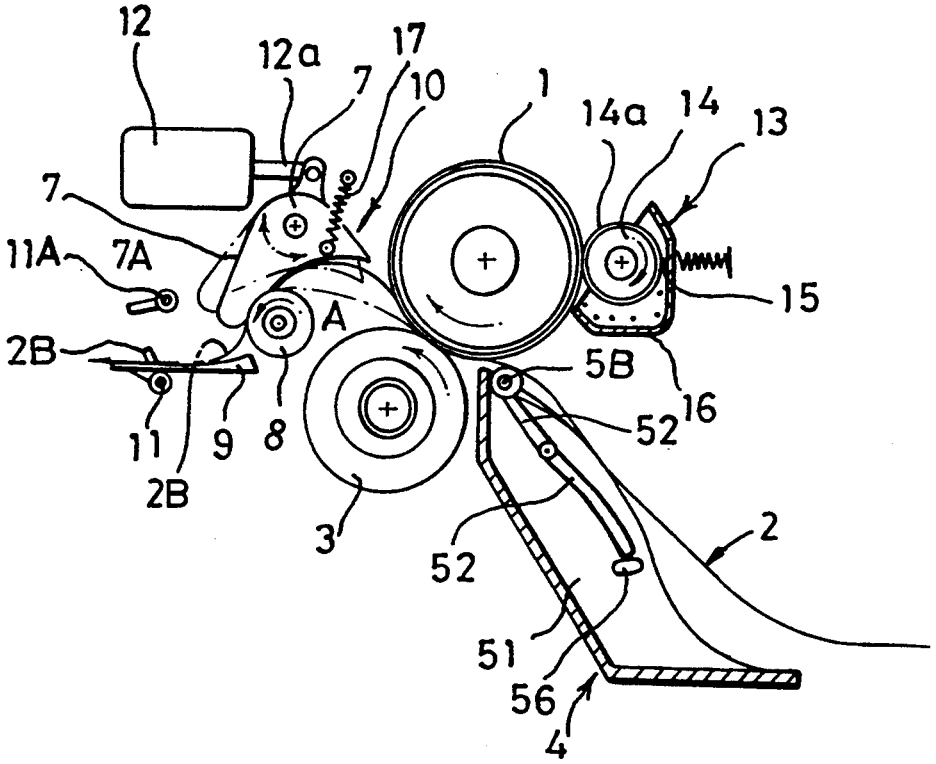
FIG. 2B is a side view of the fixing apparatus of the present invention showing the leading edge of the copy sheet inserted into the fixing roller.

As shown in FIGS. 2A, and 2B, when preceding copy sheets are fed along the feed path A through the nip defined between the peripheries of the heating roller 1 and the pressure roller 3, the arm 54, on its own weight is returned to the lower end of the curved slit 52 and rests in perpendicular relationship with the guide ribs 41, as shown in FIG. 1. Further downward movement of the arm 54 is prevented by the stop 56, which causes the arm 54 to grip the leading edges of copy sheets.

When printing is initiated, the pivotable flattening member 7 is pivoted such that an arc-shaped face of the member 7 contacts with the periphery of the discharge roller 8 and another side is in closely adjacent relationship with respect to the periphery of the heating roller 1.

The copy sheets having passed the fixing station are advanced to the discharge path B defined between the arc-shaped face of the pivotable flattening member 7 and the periphery of the discharge roller 8.

The discharge path B is curved and contiguous to the leading end of the feed path A, and constitutes a small circular arc at a portion where the discharge roller 8 contacts with the pivotable flattening member 7. With this arrangement, when the copy sheets pass through the contact portion, the bent end of the copy sheets are pressed inversely by the heat and force.

When the end of the copy sheet 2B reaches the discharge plate 9, they are bent inversely, which causes the end of the copy sheets 2 to flatten. The flattened sheets 2 pull the first sensor 11 protruding from the discharge plate 9 in the feed direction of the copy sheets, thus driving solenoid 12, causing a shaft 12*a* to advance forward.

Upon the advance movement of the shaft 12*a*, the pivotable member 7 rotates clockwise at an angle of 15 degrees, causing the arc-shaped face to move away from the discharge roller 8 and a coil spring 17 to be tensioned. The pivotable flattening member 7A is depicted in a removed position in FIG. 2C. The tension of the coil spring 17 causes it to pull the pivotable member 7 toward the discharge roller 8.

By operation of the first sensor 11, the copy sheets are lifted from the guide plate, on their own resiliency, causing the first sensor 11 to stop its operation, and the second sensor 11A to operate.

Figure 2C:
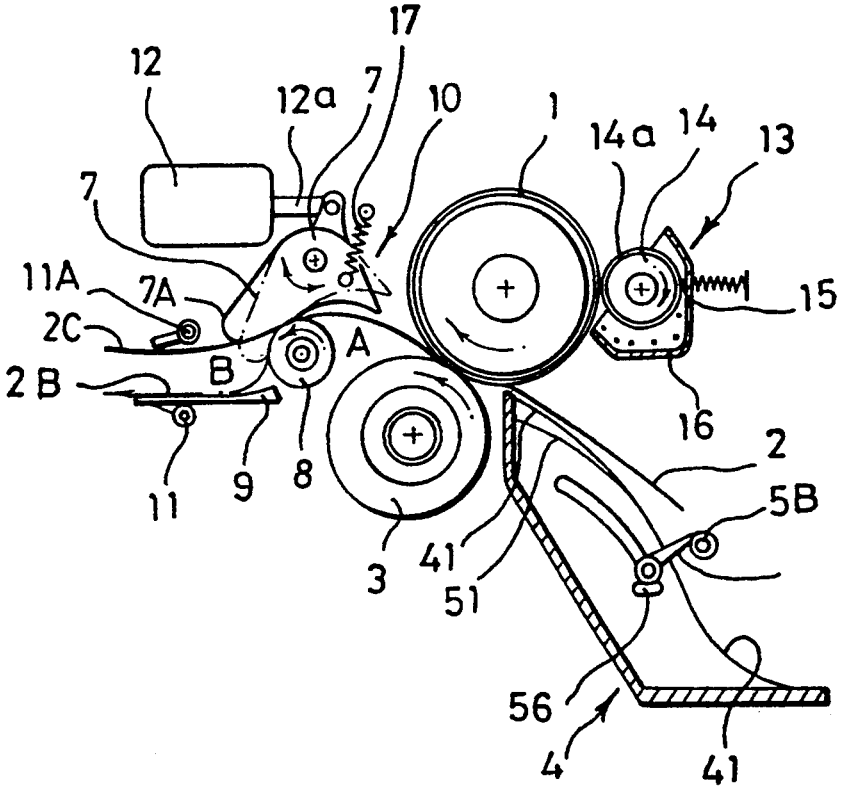
FIG. 2C is a side view of the fixing apparatus of the present invention showing the copy sheet passing a discharge path.
Figure 3:
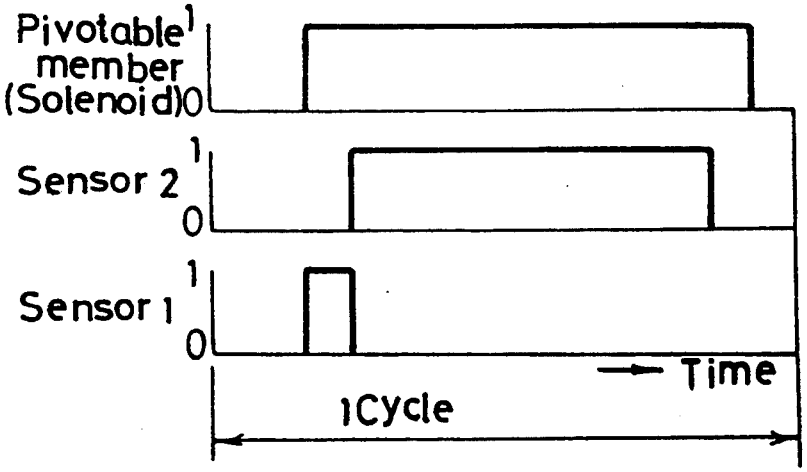
FIG. 3 is a cycle view showing the operation of sensors and a pivotable member of the fixing apparatus of the present invention.
Figure 4:
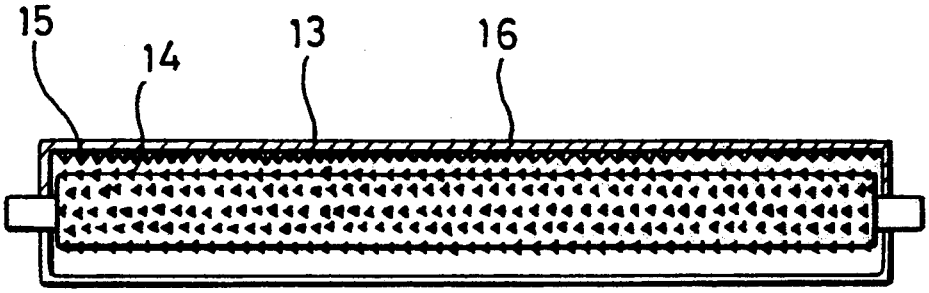
FIG. 4 is a plan view showing the internal construction of the cleaning means of the fixing apparatus of the present invention.
Figure 5:
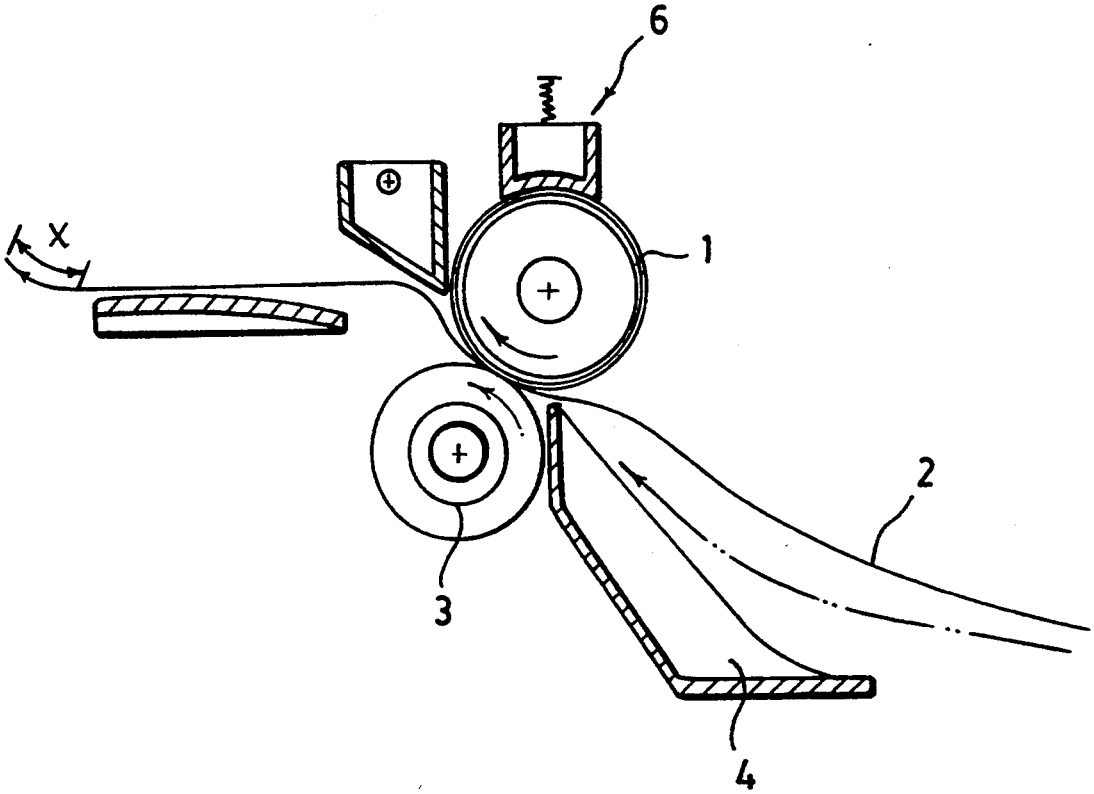
FIG. 5 PRIOR ART
FIG. 5 is a cross sectional view showing the prior art fixing apparatus.

Upon the feeding of the copy sheets 2 along the solid line in FIG. 2C, the operation of the second sensor 11A and the solenoid stop.

Upon cessation of operation of the second sensor 11A, the pivotable member 7 rotates counterclockwise for gripping the leading edges of the successive copy sheets.

The roller brush 14 is rotated in the same direction as the heating roller 1 for cleaning foreign matters on the heating roller 1. The foreign matters removed from the bristles 14*a* are collected in the cleaning box 16. The foreign matters on the bristles 14*a* are also removed by the brush cleaning member 15 and collected in the cleaning box 16. With this arrangements, the heating roller 1 and the roller brush 14 are maintained in a clean state.

What is claimed is:

1. An apparatus for fixing a copy paper for use in an electrophotographic appliance, comprising:

a fixing station for fusing a toner on copy sheets, a heating roller and a pressure roller incorporated in the fixing station, the rollers being rotatable, with adjacent peripheries of the rollers located in contact relationship, the copy sheets having passed the fixing station bowing upwardly by the linear expansion of the copy sheets;

sheet stretching means incorporating a pair of opposite sheet stretching members located adjacent to an entry side of said fixing station, each sheet stretching member including guide means having guide ribs thereon for feeding the copy sheets therealong, and a guide roller and support ribs for stretching the leading edges of the copy sheets on the guide ribs and for allowing the copy sheets to enter a nip defined between the adjacent peripheries of the heating roller and the pressure roller constituting the fixing station;

reverse pressure means including a pivotable flattening member and a discharge roller for exerting a force enabling the leading edges of the copy sheets having passed to bow downwardly while entering a discharge plate, and first and second sensors for sensing the entry or discharge of the copy sheets for adjusting a discharge path defined by the pivotable member and the discharge roller by a solenoid;

cleaning means including a cleaning box provided with a roller brush which is rotatable in the same direction as the heating roller for cleaning up the periphery of the heating roller, and a brush cleaning member for dusting off the roller brush.

2. An apparatus according to claim 1, wherein the support ribs of said sheet stretching means are higher than said guide ribs and inclined at an angle of $\theta$ for producing copy sheet stretching force during the feed of the copy sheets, each of said support ribs including a side slit and each sheet stretching member further including an arm being slidable along said slit of said support rib by a feed force of the copy sheets and returned to its original position or to a lower end of the slit, on its own weight, said guide roller being mounted at the leading end of a respective arm for gripping the leading edges of the copy sheets by the height difference between the guide and support ribs, whereby the copy sheets are removed from the guide roller upon reaching the nip defined by the heating and pressure rollers.

3. An apparatus according to claim 1, wherein the pivotable member of the reverse pressure means has an arc-shaped face at one side adjacent to the guide roller, and the solenoid being electrically connected to the first and second sensors for moving a shaft forwardly and rearwardly, the shaft at one end being connected to the pivotable member and one end of a coil spring being connected to the pivotable member.

4. An apparatus according to claim 1, wherein the roller brush has bristles rotating in the same direction as the heating roller and the brush cleaning member being fixed within the cleaning box in contact with the bristles.

5. An apparatus according to claim 1, wherein the electrophotographic appliance is a laser beam printer.

6. An apparatus according to claim 1, wherein the electrophotographic appliance is a copying machine.

* * * * *